US006226909B1

(12) United States Patent
Banning

(10) Patent No.: US 6,226,909 B1
(45) Date of Patent: May 8, 2001

(54) PRINTED DISPLAY SIGN

(76) Inventor: Herbert John Banning, 579 Darling Street, Rozelle, NSW, 2039 (AU)

( * ) Notice: Subject to any disclaimer, the term of this patent is extended or adjusted under 35 U.S.C. 154(b) by 0 days.

(21) Appl. No.: 09/249,309

(22) Filed: Feb. 12, 1999

(30) Foreign Application Priority Data

Sep. 16, 1998 (AU) ..... PP5956

(51) Int. Cl.[7] ..... G09F 13/04

(52) U.S. Cl. ..... 40/576; 40/575; 40/564; 40/594; 40/618

(58) Field of Search ..... 40/568, 575, 576, 40/595, 360, 611, 594, 618, 564

(56) References Cited

U.S. PATENT DOCUMENTS

| | | | | |
|---|---|---|---|---|
| 2,262,400 | | 11/1941 | Laws . | |
| 2,586,039 | * | 2/1952 | Heggedal | 40/618 X |
| 4,292,752 | * | 10/1981 | Clark | 40/576 |
| 4,446,640 | | 5/1984 | Kenney . | |
| 4,475,300 | * | 10/1984 | Ledenican | 40/611 X |
| 4,858,350 | | 8/1989 | Malarchik . | |
| 4,991,334 | * | 2/1991 | Amundsen | 40/575 X |
| 5,207,011 | * | 5/1993 | Coulthard | 40/568 X |
| 5,241,767 | * | 9/1993 | Fuda et al. | 40/611 |
| 5,301,090 | * | 4/1994 | Hed | 362/558 |
| 5,410,830 | * | 5/1995 | Aiken, Sr. | 40/575 X |
| 5,457,905 | * | 10/1995 | Kaplan | 40/574 |
| 5,588,238 | * | 12/1996 | Visocky et al. | 40/575 X |
| 5,636,463 | * | 6/1997 | Sharon et al. | 40/568 X |
| 5,678,333 | * | 10/1997 | Aiken, Sr. | 40/575 X |
| 5,755,050 | * | 5/1998 | Aiken | 40/575 X |
| 5,901,486 | * | 5/1999 | Sharon et al. | 40/568 X |
| 5,983,543 | * | 11/1999 | Hillstrom | 40/574 |
| 5,983,546 | * | 11/1999 | Aiken, Sr. | 40/618 |
| 6,003,258 | * | 12/1999 | Godfrey et al. | 40/611 |

* cited by examiner

*Primary Examiner*—Terry Lee Melius
*Assistant Examiner*—James M Hewitt
(74) *Attorney, Agent, or Firm*—Morgan, Lewis & Bockius LLP

(57) ABSTRACT

A printed display sign particularly for use with a light box reverse printed on its rear face with information, typically a menu for a fast food outlet. The information includes product names and aligned with each product name is a rectangular transparent window area where the sign is not printed. The rear of the sign is painted with a white diffusing layer which covers the entire rear surface of the sign apart from the windows and the areas bordering the windows which are not coated with the diffusing layer so as to leave a rectangular dark border or frame around each window. Labels having a size larger than that of the window but preferably smaller than that of the outer edge of the border can then be located essentially within the window using the outer edge of the border as a guide. The front of the label is printed with price indicia and if the label is correctly applied to the window, which can be checked by reference to the border, the price indicia should align correctly with the product name indicia. Thus the invention provides a method of ensuring that a printed display being made with adjustable prices but which includes a system to ensure that the labels displaying each price is correctly aligned with its related product name so that the appearance of the sign from the front is professional.

22 Claims, 5 Drawing Sheets

PRINTED DISPLAY SIGN

FIELD OF THE INVENTION

This invention relates to a printed display sign. In particular it relates to a printed sign for displaying information such as the types of products for sale and their prices in an establishment such as a fast food outlet. The sign may be backlit by a light box.

BACKGROUND OF THE INVENTION

Fast food outlets often provide a display sign comprising a menu of the products available and photographs of those products behind the counter of the outlet at approximately head height. The signs are often backlit using a light box to create an illuminated display. In one existing display system, the front of the display comprises an acrylic panel which defines a series of pairs of rails or the like into which printed display panels can be inserted. The panels indicate the name of a product such as "cheeseburger". The price of that product is also printed on a panel and is also inserted between the rails aligned with the name of the product. If the price changes, the panel which displays the price can be removed and replaced with a new panel showing the new price. In some more sophisticated display systems, individual figures on the pricing panel can be removed and replaced. Thus, for example, a price of $2.30 could be amended to read $2.35 by simply removing the end "0" and replacing it with a "5".

There are two problems with the existing display system described above. First, it is quite complex, compared with just printing a menu and is consequently expensive. Secondly, the arrangement of rails and panels is relatively bulky and occupies much of the surface area of the light box display leaving less space for the display of photographs of the products available at the outlet. This is generally undesirable as often the product photographs "sell the product" more than the printed menu and generally the more photographs displayed, the better the product sales are at a particular outlet. Also, since the display is modular, its appearance is not as uniform and smart as a simple printed panel displaying the same information would be.

Ideally, the display should be as professional looking as possible with all the names and prices horizontally and vertically aligned in correct registration to give a good impression to customers. A scruffy menu display might give customers the impression that the outlet's standards, including perhaps its hygiene standards, were low.

If instead of having a display where the prices and names of products can be changed, a printed sheet displaying all the current menu information is used, the lettering takes up less surface area than the rails and panels. The same information can be displayed on a smaller surface area and the menu display can be smaller, allowing more pictures to be displayed on the light box. Justification of the product names, and horizontal and vertical alignment of the product names and prices can be more accurately controlled. The overall appearance is also more professional and smarter than having removable prices. The printed sheet menu display can be backlit more effectively by the light box. However, the problem with such a printed menu is that if the price of any of the products is to be changed, whether permanently, or in the case of a special promotion temporarily, the entire display sign has to be reprinted.

It is an object of the present invention to alleviate the disadvantages of the prior art discussed above and provide an improved printed display sign.

SUMMARY OF THE INVENTION

According to the present invention, there is provided a printed display sign including a sheet of transparent material defining a front face which displays printed information and a rear face, wherein information visible from the front face is printed on the rear face of the sign to be read from the front face, the information including at least a first indicia such as a product name or the like and at least one transparent window area aligned in registration with that first indicia, wherein a frame extends around the window areas on the rear face of the sign, the frame being non-visible from the front of the sign and whereby a removable label having an adhesive front face, displaying second indicia, such as price indicia or the like on said adhesive front face, and being of a size larger than that of the window, may be applied to cover the window area by using the frame as a guide, so that the second indicia is aligned in correct registration with the second indicia.

Typically the printed display will be a menu for a "fast food" outlet and the product names will be food items.

When the inventor originally attempted to design a printed display menu with transparent windows, behind which removable price tags could be located to enable the prices of the various products to be changed without throwing away the entire sign, the inventor discovered that when the prices were stuck on the rear face of the sign, it was impossible to ensure that the prices were correctly aligned. Viewed from the front, the printing looked uneven and the display sign was commercially unacceptable. After trying out a number of systems, the inventor discovered that the provision of a frame around the outside of the window provides a guide on the rear of the sign which can be used to ensure that each price is correctly aligned with its related product name so that the appearance of the sign from the front is satisfactory.

Typically, the sign will be screen printed with headings such as "breakfast" or "beverages" printed on the rear of the transparent medium first, followed by a dark colored background such as black or brown, leaving blank spaces defining the windows and the lettering for the products such as "cheese burger" or the like. Following that stage, a coat of white paint is applied to the rear of the screen over the previously applied paint. This white layer acts as a diffuser when the sign is placed in front of a light box and makes the display less harsh on the eye than if the transparent areas defining the lettering were left clear. The white paint is applied in such a way that it does not extend as far as the edges of the window but leaves a dark border or perimeter around the window. This border defines the frame for the window.

Ideally, the windows and the adhesive labels displaying prices will be rectangular. The labels will typically be made from vinyl and are coated with a low tack adhesive so that they can be easily removed from the display sign for replacement.

In a particularly preferred embodiment, as well as including windows for prices, the sign also includes elongate windows for product name indicia and further windows for prices. Normally those windows will be blanked out with plain labels the same color as the dark background. However, it is possible to add new product lines or "specials" to the sign, if desired, by removing the plain dark labels from the windows and replacing them with appropriate labels displaying the new product information.

The display sign is typically used with a lightbox thus the invention also provides a light box and printed display sign assembly comprising in combination:

a) a lightbox;

b) a printed display sign positioned so as to be backlit by the light box, said printed display sign comprising a sheet of transparent material defining a front face and a rear face, information being reverse printed on the rear face of the sign so as to be readable from the front face, the information including a series of first indicia such as product names printed in at least a first color, the sign being printed with a second background color, different from the first color, defining a series of transparent windows defining an area, aligned with at least some of those product names, the rear face of the sign being coated with a diffuser layer which defines a frame around each window; and c) removable labels larger in size than the area of the windows displaying second indicia, typically price indicia, reverse printed on a front face of each label, the labels being applied to the rear of the sign covering the window areas, the frames enabling correct location of a said label in a said window such that the that the second indicia are aligned in correct registration with the first indicia to which the second indicia relates.

The present invention thus provides a low cost and flexible system that can provide professional looking signage at a much reduced cost from the adjustable signage currently available. The quality attainable is such that from the front it appears as if the entire sign has been screen printed. The provision of the frame by the rear light diffusing layer means that the actual cost of producing a frame around the window for location of the price indicia does not add to the manufacturing process since the provision of the diffusing layer is a required step in the process for making the sign.

BRIEF DESCRIPTION OF THE DRAWINGS

A specific embodiment of the present will now be described, by way of example only, and with reference to the accompanying drawings in which.

DETAILED DESCRIPTION OF A PREFERRED EMBODIMENT

Figure 1:
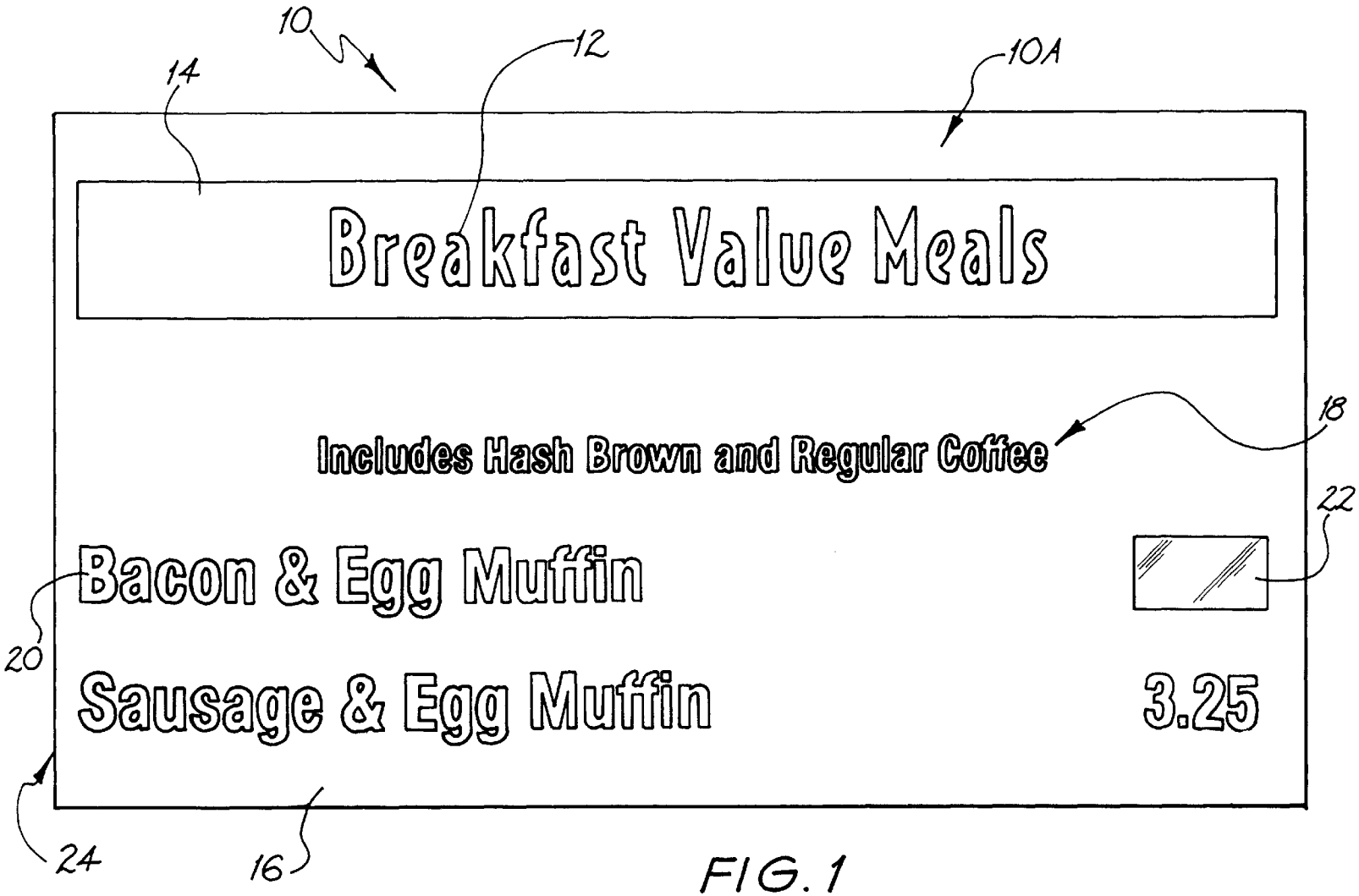
FIG. 1 is a front view of part of a printed display sign embodying the present invention.
Figure 2:
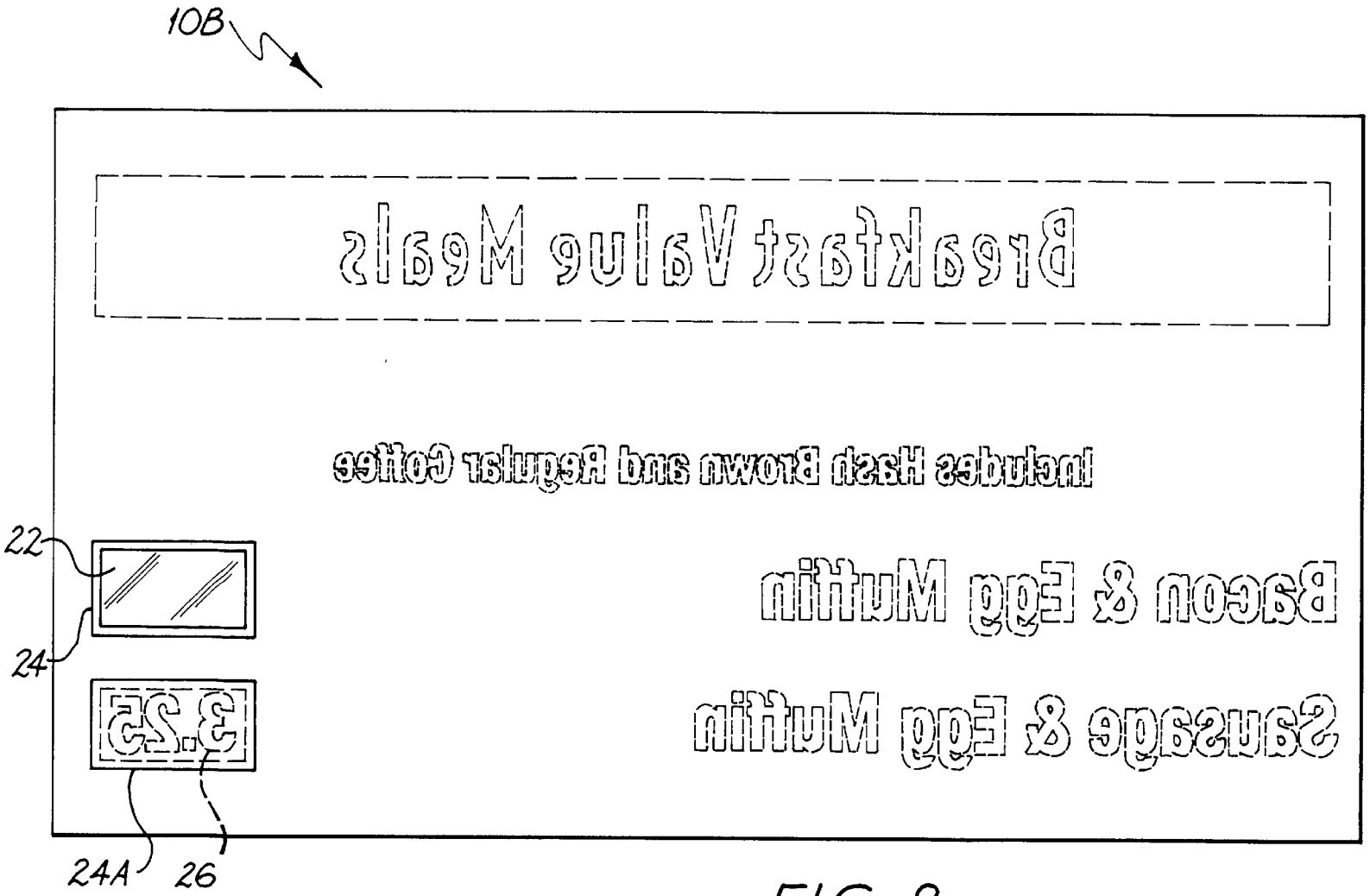
FIG. 2 is a rear view of the part of the sign shown in FIG. 1.

Referring to the drawings, a sign 10 has a front face 10A as shown in FIG. 1 and a rear face 10B shown in FIG. 2.

The sign comprises a sheet of polycarbonate which is printed on its reverse side. Reverse side printing protects the printing from damage by contact with the front face of the sign. The front face of the sign may be coated with a protective layer. The polycarbonate is typically about a half a 5 mm thick although other thicknesses could be used.

Turning to FIG. 1, the front of the sign shows a heading "Breakfast McValue Meals" 12 which is set against a rectangular background area 14. Although the particular colours used are not critical, the lettering is blue and the background is yellow since that particular color combination tends to attract the eye of a customer and can be easily seen. Generally speaking, the blue lettering 12 is first printed on the reverse side of the polycarbonate sheet and then the yellow background 14 is printed, subsequently, although printing the yellow first is possible. Typically, the display is screen printed using epoxy inks. After the blue and yellow areas 12 and 14 have been printed, the dark background 16 is then printed. The area covered by the background 16 is the entire rear surface of the sign but excluding the following:

i) the already printed areas 12, 14;

ii) areas which are left unprinted and transparent and which when read from the front provide general menu information 18 such as "includes Hash Brown and Regular Coffee"; and iii) areas which are left unprinted and transparent and which when read from the front provide product name indicia corresponding to a product, for example "Bacon and Egg McMuffin™" 20; and iv) aligned in registration with each product name indicia, a rectangular transparent window area 22.

Note that, although in FIG. 1, it appears that there is no rectangular window area 22 aligned with the indicia "Sausage & Egg McMuffin™", the price "3.25", as will be explained below, is on a removable label/sticker and is not printed on the display sign. If the label/sticker were removed, a rectangular window similar to window 22 would be seen.

The final coating on the rear of the sign, shown in FIG. 2 is a layer of white epoxy paint which acts as a diffuser. This layer coats the entire rear surface of the sign apart from a series of rectangular areas 24, of slightly greater size than the transparent windows 22. The layer of white paint acts as a diffuser and makes the sign less harsh to view, when the sign is placed in front of a light box. As can be seen the light diffusing layer is printed such that it leaves a rectangular boundary or frame 24 around the window 22. A similar boundary 24A can be seen around the window associated with the "Sausage & Egg McMuffin™" indicia. Note that, because the diffuser layer is white and thin it is possible to discern the previously printed darker layers of paint and lettering through the diffuser layer when viewing the rear of the sign.

The labels displaying the price information 26, are made of vinyl and the front of the labels which is stuck against the window is coated with a low tack adhesive so that the labels can be easily peeled off. The use of a frame around the window enables every label to be correctly aligned and justified with the other prices in the display. For best results, each label should ideally be stuck in an identical fashion to the other labels, for example each label 26 may be stuck flush with the upper surface of the windows 22 so that a thin uniform black line can be seen between the rear surface of the label 26 and the diffusing layer.

Each label 26 is also preferably coated with a layer of white paint as a diffuser. When the price has to be changed, the label is simply peeled off and replaced with a new label. The labels should be larger than the windows 22 but are preferably slightly smaller than the frame perimeter so that they fit inside the frame perimeter leaving a dark rectangular perimeter around the label.

It is also possible using the principle of the present invention to provide elongate rectangular windows (not shown) which would normally be covered with a plain black label matching the dark background of the sign but which can be peeled off to enable an extra product name to be added to the list of products available. A corresponding aligned window is also provided for the price of that product.

FIGS. 3*a* to 3*h*, illustrate a step by step process for changing the price of one of the menu items. In the first step illustrated in FIG. 3*a*, the sign 10 is placed face down on a clean flat surface with the rear 10B of the sign facing upwards.

Figure 3A:
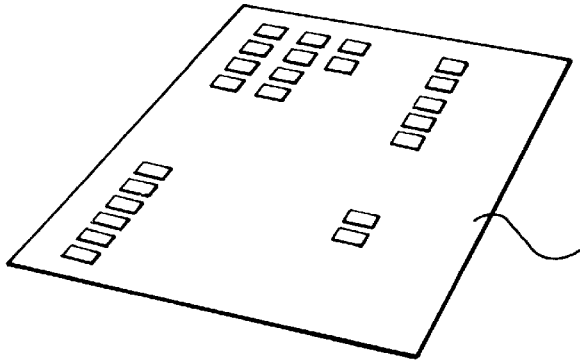
FIGS. 3*a* to 3*h* illustrate the steps involved in changing a price on a printed display sign embodying the present invention.
Figure 3B:
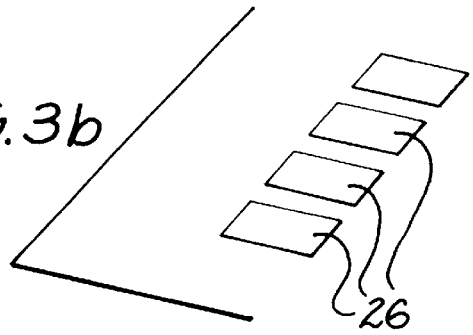

FIG. 3*b* is an enlarged view of a corner of the sign and a restaurant worker observing the rear of the sign will notice a white background with certain areas having attached stickers or labels 26 already in place.

Figure 3C:
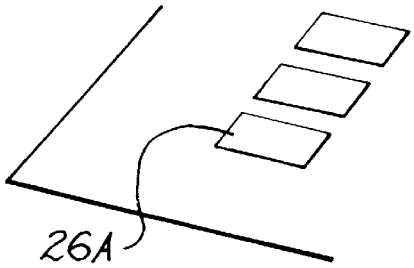

Turning to FIG. 3*c*, the worker then has to determine which label or labels are to be changed, say sticker 26A.

Figure 3D:
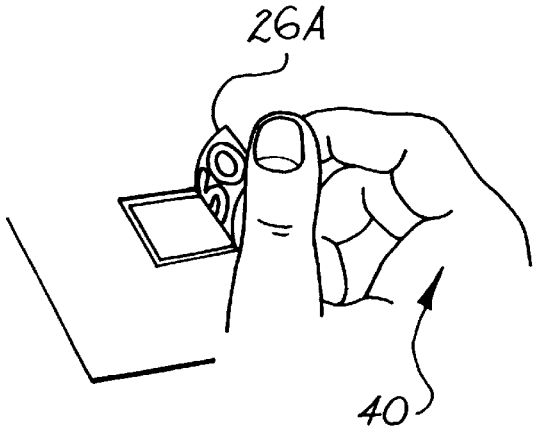

With reference to FIG. 3*d*, the worker 40 then simply peels off the label 26A which it is desired to remove. The front face of the label is the colour of the background of the sign, aside from the numbering appearing on the label.

Figure 3E:
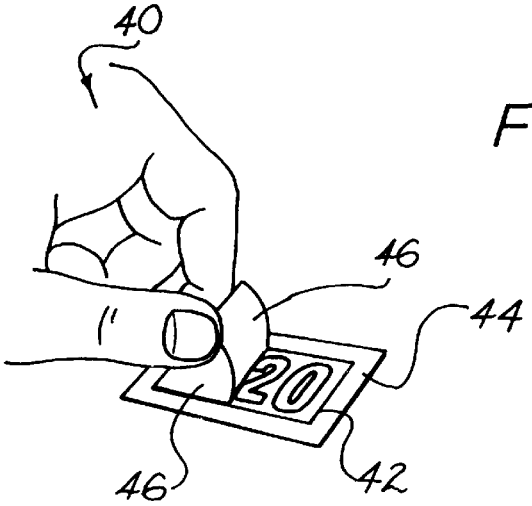
Figure 3F:
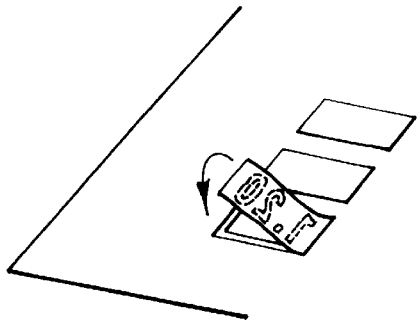

Next the worker takes a replacement label 42. In order to protect the label a white paper cover 46 protects the sticky front face of the label and a clear plastic cover 44 protects the rear of the label. The clear plastic cover 44 also helps prevent the label 42 deforming or stretching when it is applied to the rear of the display sign. After selecting a label displaying the correct price, the paper cover 46 is removed as shown in FIG. 3*e* and the label is carefully placed in the middle of the exposed frame on the rear of the sign using the frame defined by the white border of the diffuser layer as a guide. Typically, thin dark rectangle would be defined around between the label and the edge of the diffuser layer which will indicate to the operator that the label is evenly applied.

Figure 3G:
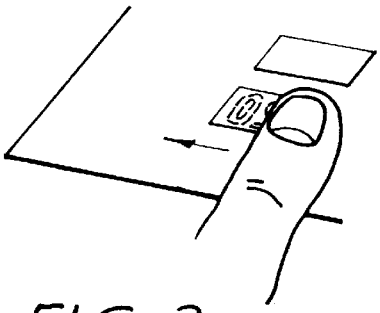
Figure 3H:
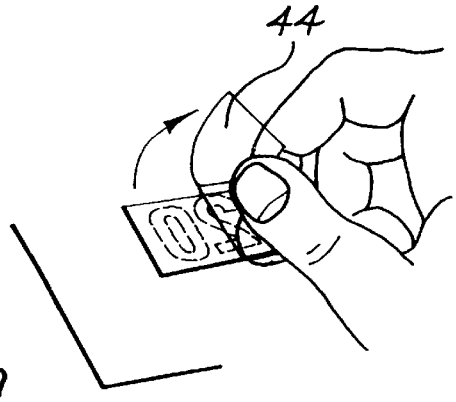

Finally as illustrated in FIGS. 3*g* and 3*h*, the label is rubbed to ensure that there are no air bubbles trapped between the label and the rear of the display sign and the clear plastic cover 44 is peeled off.

The operation is repeated for any other labels/stickers which have to be changed and the sign is then replaced in the light box.

Figure 4:
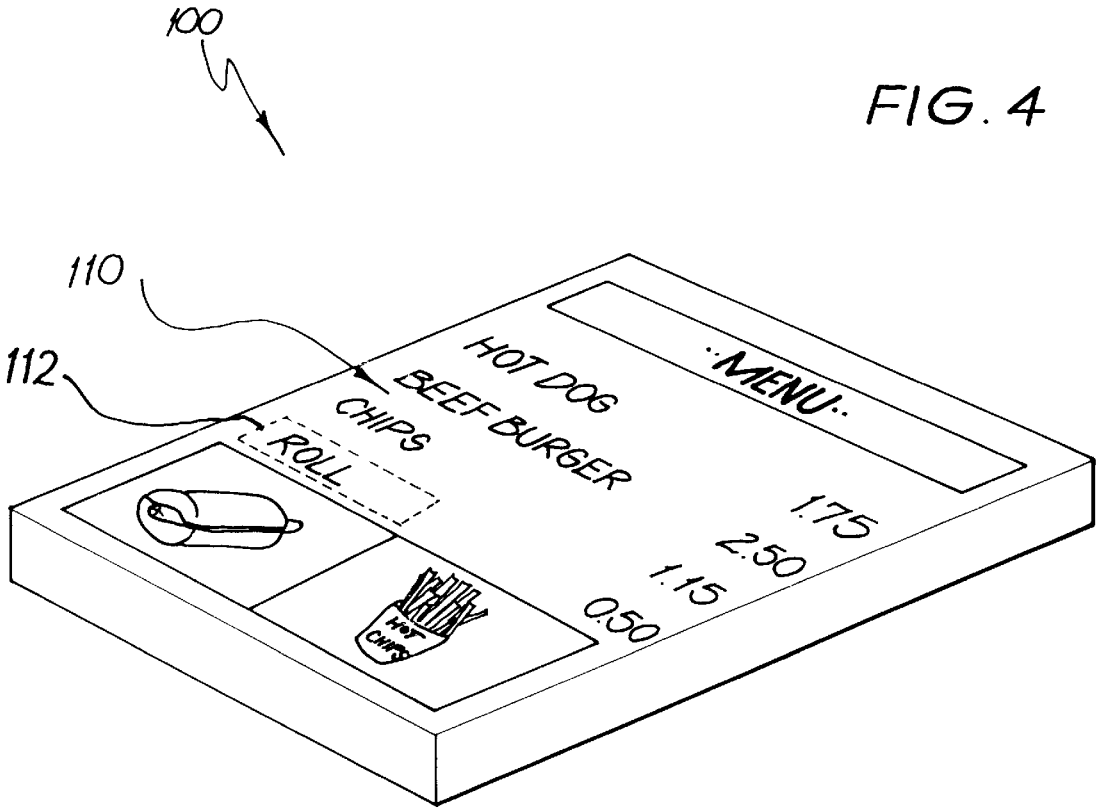
FIG. 4 is a schematic perspective view of a light box incorporating a display sign.

FIG. 4 is a view of a lightbox 100 illuminating a printed display sign 110 embodying the present invention. The indicia "roll" is carried on an elongate label 112 shown in dotted lines but which in practice, is not visible from the front of the sign.

Thus the present invention provides a system in which a sign which appears to be entirely screen printed, such is the quality of the justification/registration which is possible, can in fact be simply and cheaply amended to alter the prices of the product, and the product name.

Although the above description refers to the use of the signage of the menu for fast food outlets and particularly with lightboxes, the sign could also be used with printed display signs displaying other information which may need to be altered over time.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A printed display sign including a sheet of transparent material defining a front face which displays printed information and a rear face, wherein said printed information is printed on the rear face of the sign to be read from the front face and a background is printed over at least part of the rear face of the sign thus rendering the at least part of the rear face of the sign non-transmissive to visible light, the printed information including at least one first indicia and wherein at least one transparent window area is defined in the background and is aligned in registration with said at least one first indicia, and wherein a guide frame for a label is formed on the rear face of said display sign, said frame extending at least part way around the at least one transparent window area on the rear face of the sign, the frame being non-recognizable from the front of the sign, and a removable label having an adhesive front face, displaying second indicia on said adhesive front face, and being of a relatively larger size than the at least one transparent window area, is applied to cover the at least one window area inside the guide frame so that the second indicia is aligned with the at least one first indicia.

2. A printed display sign as claimed in claim 1 wherein the at least one first indicia is a product name.

3. A printed display sign as claimed in claim 2 wherein the sign is screen printed with at least one heading reverse printed on the rear face of the transparent material in a first color; and wherein the background is a dark colored layer, and defines non printed areas defining alphanumeric lettering for the product names; and wherein a layer of white paint partly coats the rear face of the sign and covers over the alphanumeric lettering and part of the background layer, but does not extend as far as edges of the at least one transparent window area as defined by the dark colored background layer, wherein a boundary between the layer of white paint and a part of the background layer surrounding the at least one transparent window area defines the frame.

4. A printed display sign as claimed in claim 3 wherein the at least one transparent window area and the removable label are rectangular, and wherein the adhesive on the label is a low tack adhesive.

5. A printed display sign of claim 3 wherein said dark colored background layer is selected from the colors black and brown.

6. A printed display sign of claim 1 wherein the at least one first indicia is a product name and wherein the second indicia is a price indicia.

7. A printed display sign as claimed in any preceding claim wherein the said removable label is a price label displaying price details and wherein the sign further includes at least one elongate window having an associated frame means for receiving at least one second type of removable label distinct from the price label, said second type of label showing either product name indicia or a plain label of the same color as the dark background.

8. A light box and printed display sign assembly comprising in combination:

a) a light box;

b) a printed display sign positioned so as to be backlit by the light box, said printed display sign comprising a sheet of transparent material defining a front face and a rear face, a first indicia that includes product names being reverse printed in a first color on the rear face of the sign so as to be readable from the front face, a background layer of a second color, at least one transparent window defined in the background layer and defining an area, said at least one window area being aligned with at least one of said product names, the rear face of the sign being coated with a diffuser layer which defines a frame extending at least part way around said at least one window; and c) a removable label larger in size than the at least one window area, displaying second indicia reverse printed on a front face of the label, the label being applied to the rear face of the sign to cover the at least one window area, the frame facilitating correct placement of the label in the at least one window area such that the second indicia is aligned with the first indicia.

9. A light box and printed display sign assembly as claimed in claim 8 wherein the at least one window and the removable label are rectangular.

10. A light box and printed display sign assembly as claimed in claim 8 wherein the front face of the label is coated with a low tack adhesive.

11. A light box and printed display sign assembly as claimed in claim 8 wherein the sign further defines an elongate window and an associated window for prices in registration with the elongate window, a frame extending around the elongate window on the rear face of the sign.

12. A light box and printed display sign assembly as claimed in claim 11 wherein the elongate window and the associated window are blanked out with plain labels of the second color that are substantially non-distinguishable from the background layer when viewed from the front face of the display sign.

13. A light box and printed display sign assembly as claimed in claim 11 wherein a label located behind the elongate window displays extra product lines.

14. A printed display sign and label assembly comprising in combination:

a) a sheet of transparent material defining a front face which displays printed information against a printed opaque background layer and a rear face, wherein the printed information is printed on the rear face of the sign to be read from the front face, the background layer defining at least one transparent window area and wherein a frame extends around the at least one window area on the rear face of the sign, the frame being formed on the rear face of the material and being non-recognizable from the front face of the sign; and b) a removable label having an adhesive front face, displaying price indicia on said adhesive front face, and being of a size larger than that of the at least one window area, applied to the rear face of the sign to cover the window area, the label being located in a predetermined position by way of the frame acting as a guide.

15. A display sign displaying information including a single sheet of transparent material defining a front face and a rear face, wherein said information is readable from said front face, and wherein a background layer is printed on the rear face of the sign, thus rendering at least part of the rear face of the sign non-transmissive to visible light, wherein a first elongate transparent window is defined in the background layer and a second transparent window is defined in the background layer, said second transparent window being aligned in registration with said first elongate transparent window, and wherein a first guide frame is formed on the rear face of said display sign, said first guide frame extending around the first elongate transparent window area on the rear face of the sign, the frame being non-recognizable from the front face of the sign, and wherein a second guide frame is formed on said rear face, said second guide frame extending around the second windows, said second guide frame being non-recognizable from the front face of the sign.

16. A display sign as claimed in claim 15 wherein the rear face of the sign is at least partly coated with a layer of diffusing white paint and wherein for at least one of the window the boundary between the layer of white paint and a part of the background layer surrounding at least one of the transparent windows defines the guide frame for a label.

17. A printed display sign as claimed in claim 1 wherein a plurality of transparent window areas are defined in the background.

18. A printed display sign as claimed in claim 17 wherein the sign is screen printed with at least one heading reverse printed on the rear face of the transparent material in a first color; and wherein the background is a dark colored layer, and defines non printed areas defining alphanumeric lettering; and wherein a layer of white paint partly coats the rear face of the sign and covers over the alphanumeric lettering and part of the background layer, but does not extend as far as edges of the at least one transparent window area as defined by the dark colored background layer, wherein a boundary between the layer of white paint and a part of the background layer surrounding the at least one transparent window area defines the frame.

19. A display sign displaying information comprising a sheet of transparent material defining a front face and a rear face, wherein said information is readable from viewing said front face, and a background layer is printed over at least part of the rear face of the sign thus rendering the at least part of the rear face of the sign non-transmissive to visible light, wherein a first elongate transparent window is defined in the background layer and wherein a second transparent window is defined in the background layer and is aligned with the first elongate transparent window, and wherein a printed guide frame is defined on the rear face of the display sign, said frame extending at least part way around the first elongate transparent window on the rear face of the sign, the frame being non-recognizable from the front of the sign, and wherein an elongate removable label having an adhesive front face, displaying first indicia on said adhesive front face, and being of a relatively larger size than the first elongate transparent window, is applied to cover the elongate window inside the first guide frame, and wherein a second guide frame is defined on the rear face of said display sign, said second frame extending at least part way around the second transparent window, and a removable label having an adhesive front face displaying second indicia on said adhesive front face, and being of a relatively larger size than said second window is applied to cover the transparent window inside the second guide frame, the second indicia being aligned with the first indicia.

20. A display sign as claimed in claim 19 wherein the first indicia is a product name.

21. A display sign as claimed in claim 19 wherein the sign is screen printed with at least one heading reverse printed on the rear face of the transparent material in a first color; and wherein the background is a dark colored layer; and wherein a layer of white paint partly coats the rear face of the sign and covers over part of the background layer, but does not extend as far as edges of the transparent windows defined by the dark colored background layer, wherein a boundary between the layer of white paint and a part of the background surrounding each transparent window defines each respective frame.

22. A display sign as claimed in claim 19 wherein the transparent windows and the adhesive labels are rectangular, and wherein the adhesive on the labels is a low tack adhesive.

* * * * *